US006807713B2

(12) United States Patent
Röck

(10) Patent No.: US 6,807,713 B2
(45) Date of Patent: Oct. 26, 2004

(54) HINGE FOR MOUNTING A DOOR ON A FRAME OF AN ARTICLE OF FURNITURE

(75) Inventor: Siegfried Röck, Höchst (AT)

(73) Assignee: Julius Blum Gesellschaft M.B.H., Höchst (AU)

( * ) Notice: Subject to any disclaimer, the term of this patent is extended or adjusted under 35 U.S.C. 154(b) by 26 days.

(21) Appl. No.: 10/310,841

(22) Filed: Dec. 6, 2002

(65) Prior Publication Data

US 2004/0107542 A1 Jun. 10, 2004

(51) Int. Cl.[7] ..... E05D 5/02
(52) U.S. Cl. ..... 16/387; 16/382
(58) Field of Search ..... 16/387, 382, 240, 16/242, 249, 236–238, 272

(56) References Cited

U.S. PATENT DOCUMENTS 4,604,769 A * 8/1986 Rock et al. ..... 16/238
4,642,846 A * 2/1987 Lautenschlager ..... 16/382
4,716,622 A * 1/1988 DeBruyn ..... 16/297
5,454,144 A * 10/1995 Rupprechter ..... 16/382
5,826,305 A * 10/1998 Domenig et al. ..... 16/235
5,884,364 A * 3/1999 Domenig et al. ..... 16/249
6,015,252 A * 1/2000 Peck ..... 411/387.1
6,049,946 A * 4/2000 Cress et al. ..... 16/240
6,203,231 B1 * 3/2001 Salice ..... 403/12
6,442,798 B1 * 9/2002 Rupprechter ..... 16/242

* cited by examiner

*Primary Examiner*—Chuck Y. Mah
(74) *Attorney, Agent, or Firm*—Wenderoth, Lind & Ponack, L.L.P.

(57) ABSTRACT

A hinge for mounting a door on a frame of an article of furniture such as a cabinet or desk, includes a hinge member adapted to be mounted to a door and a hinge arm. The hinge arm has a first end pivoted to the hinge member mounted to the door and a second end which is adapted to be mounted to the frame. The second end of the hinge arm has first and second flanges disposed at a right angle to each other to abut first and second sides of the frame when in the mounted position. A fastening screw is received in an opening of the second flange and extends parallel to said first flange. A threaded section of the fastening screw protrudes from the second flange. The length L of the first side flange in a direction perpendicular to the second flange is greater than the length l of the protruding part of the threaded section of said fastening screw.

7 Claims, 4 Drawing Sheets

HINGE FOR MOUNTING A DOOR ON A FRAME OF AN ARTICLE OF FURNITURE

BACKGROUND OF THE INVENTION

1. Field of the Invention

The present invention relates to a hinge for mounting a door on a frame of an article of furniture such as a cabinet or desk with a first hinge member adapted to be mounted to a door and a second hinge member being adapted to be mounted on the frame. The second hinge member is in the form of a hinge arm having a first end pivoted to the first hinge member and a second end being adapted to be mounted to the frame, the second end has first and second flanges disposed at a right angle to each other to abut first and second sides of the frame when in the mounted position, a fastening screw is received in an opening of the second flange and extends parallel to the first flange, whereby a threaded section of the fastening screw protrudes from the second flange.

2. Description of the prior art

Various types of hinges for mounting a door on a frame of a piece of furniture have been used in the furniture and cabinet industry. One such device is known from U.S. Pat. No. 4,554,706 whereby a hinge arm is mounted on a mounting plate which has U-shaped configuration with two side flanges and a middle flange whereby a fastening screw protrudes through an elongated opening in the middle flange said fastening screw securing the mounting plate of the hinge to the frame.

U.S. Pat. No. 5,884,364 shows a hinge with a fastening screw pre-mounted in the hinge arm mounting plate.

SUMMARY OF THE INVENTION

General purpose of the present invention is to provide an improved hinge for mounting a door on a frame of an article of furniture such as a cabinet or desk which provides for mounting of the hinge arm on the frame without the necessity of drilling a hole for the fastening screw into the frame.

According to the invention this is achieved by the length L of the first side flange in a direction perpendicular to the second flange being greater than the length l of the protruding part of the fastening screw.

Because the length of the first flange is longer than the length of the fastening screw protruding from the second flange when mounting the hinge on the frame, the hinge arm with the second flange can abut against the side of the frame before the tip of the screw comes into contact with the frame, thereby facilitating the positioning of the hinge arm. When the fastening screw, which is held in the second flange of the hinge arm is a self-tapping screw, it can easily be screwed into the frame also when there is no pre-drilled hole for the fastening screw.

According to a preferred embodiment the opening for the fastening screw is an elongated opening having elongated rims the threaded section of the fastening screw being co-operatively engaged by said rims and the fastening screw has a head and an unthreaded shaft section extending between the head and the threaded shaft section over a distance that is greater then the thickness of the second flange.

This embodiment makes it possible to adjust the position of the hinge in the direction of the height of the frame over the length of the elongated opening if such a correction proves to be necessary.

BRIEF DESCRIPTION OF THE DRAWINGS

Exemplary embodiments of the invention are described in detail below with reference to the appended drawings wherein.

DETAILED DESCRIPTION OF THE INVENTION

Figure 1:
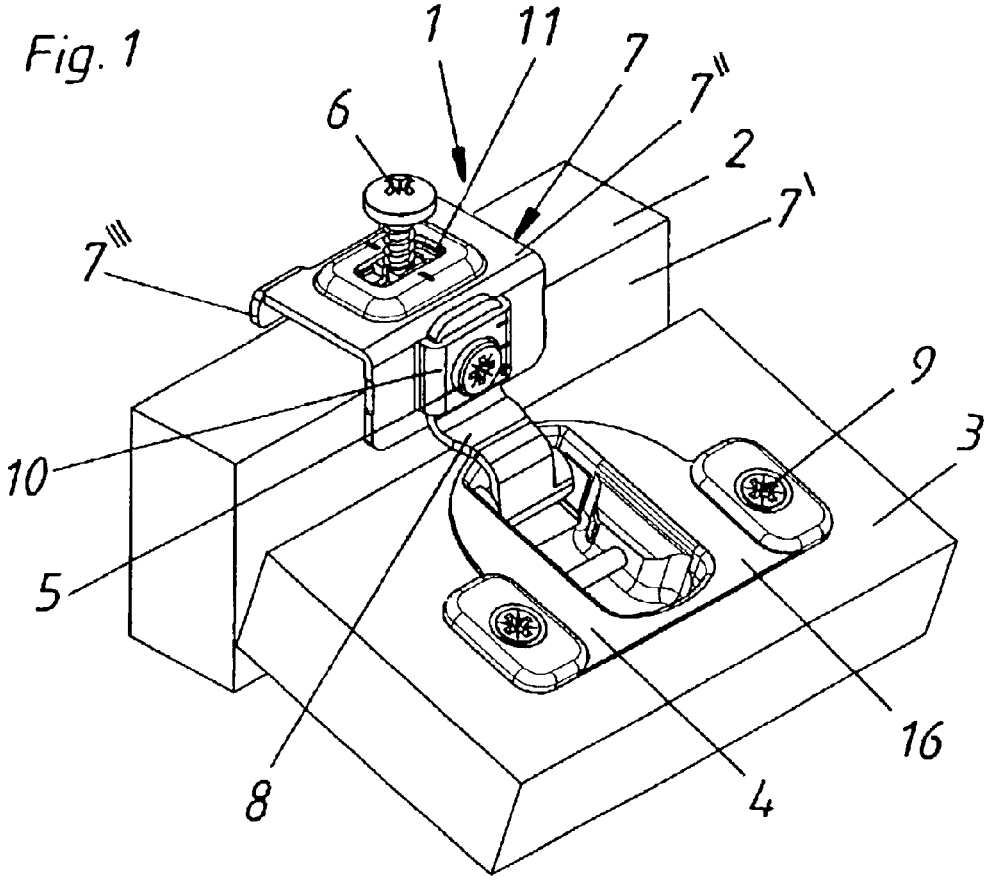
FIG. 1 is a perspective view of a hinge according to the invention in a position when the hinge arm is to be mounted, sections of a frame and of a door being shown.
Figure 2:
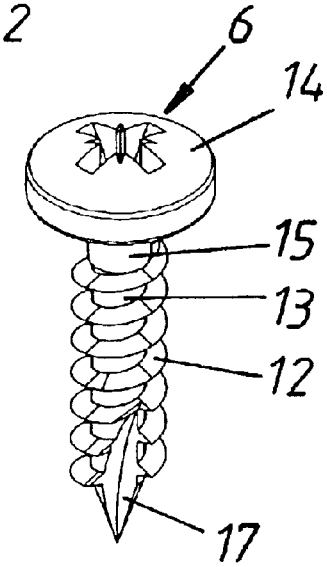
FIG. 2 is a perspective view of a fastening screw.

In the drawings only parts of the door frame 2 and the door 3 are shown. The door 3 is mounted on the frame 2 by two or more hinges 1 according to the invention. In the drawings the door 3 is shown in an opened position. The hinge 1 includes a hinge boss 4 and a hinge arm 8. One end of the hinge arm 8 is hinged to the hinge boss 4 by means of a hinge pin. The hinge boss 4 is set into a drilled hole in the door 3 and screwed onto the door 3 by means of screws 9 which project through holes in the flange 16 of the hinge boss 4.

Figure 3:
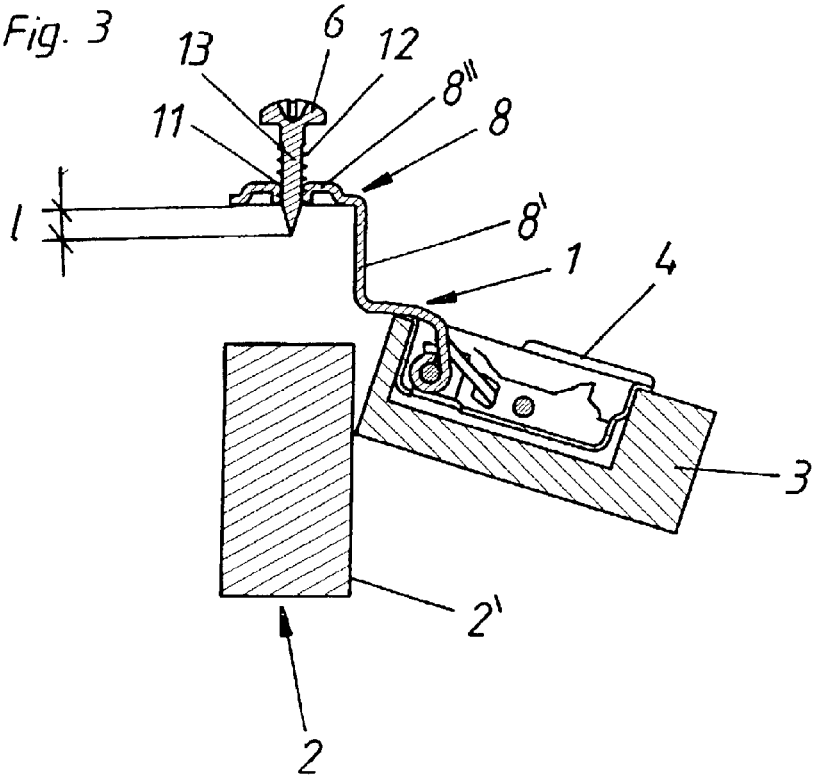

In the embodiment shown in FIG. 3 the other hinge arm 8 is provided with a first flange 8' and a second flange 8" which are at a right angle to each other. The fastening screw 6 is held in an opening 11 of the second flange 8". The opening 11 is advantageously an elongated opening 11. The elongated opening 11 has elongated rims, the fastening screw 6 is co-operatively engaged by said rims so that before mounting of the hinge 1 on the frame 2 the fastening screw 6 is held in a middle position of the elongated opening 11. The fastening screw 6 is mounted in the second flange 8" of the hinge arm in a partly screwed imposition as shown in FIG. 3. The fastening screw 6 is provided with a threaded section 12 having a self-cutting thread which is inserted in the elongated opening 11 and engaged by the opposed rims of the elongated opening 11. The fastening screw 6 has a shaft 13. The threaded section 12 has a major diameter than the shaft 13, whereby the diameter of the threaded section 12 is the diametric distance measured between the crests of the thread on opposing sides of the threaded section 12.

The fastening screw 6 is further provided with a head 14 which has a diameter that is greater than the width of the elongated opening 11. The fastening screw 6 is provided with an unthreaded section 15 extending between the head 14 and the threaded section 12. The unthreaded section 14 extends over distance that is greater than the thickness of the flange 8". When the hinge arm 8 is mounted on the frame 2 it is positioned by means of the fastening screw 6 which can be turned into the frame 2 without a hole being drilled into the frame thereby fastening the hinge 1 to the frame 2. If it is necessary to correct the position of the hinge 1 with respect to the frame 2 the fastening screw 6 is unscrewed and loosened slightly from its fully screwed in position so that the unthreaded section 15 corresponds to the rims of the elongated opening 11. Now, the hinge arm 8 can be re-positioned on the frame 2 in a vertical direction either upward or downward over distance corresponding to the length of the elongated opening 11. When the hinge 1 is in its correct position the fastening screw 6 can be tightened and the hinge 1 is again fastened to the frame 2.

Figure 4:
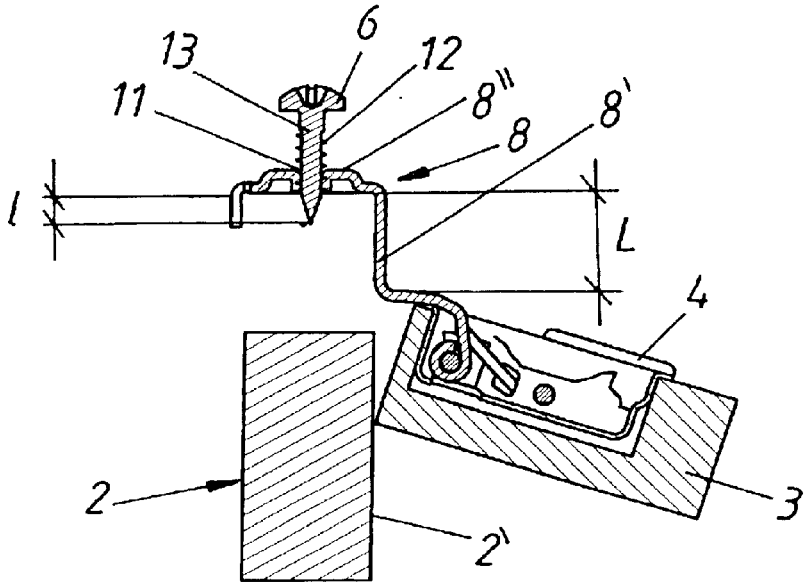
FIGS. 3 to 6 are horizontal sectional views of different embodiments of the hinge, parts of the frame and the door being shown.
Figure 7A:
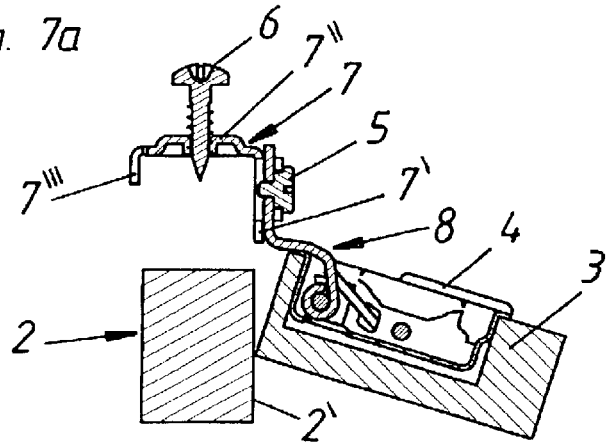
FIGS. 7*a* to 7*d* are horizontal sectional views of the hinge, the frame and the door whereby the hinge arm is shown in difference stages of the mounting process.
Figure 7B:
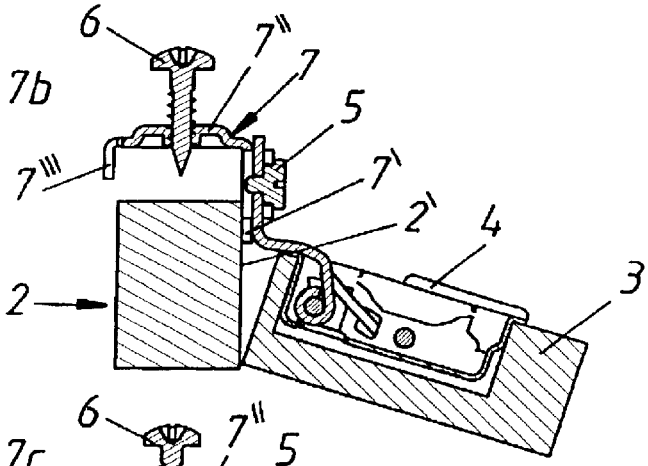
Figure 7C:
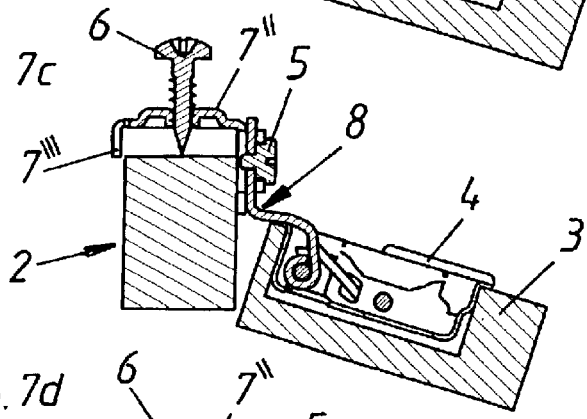
Figure 7D:
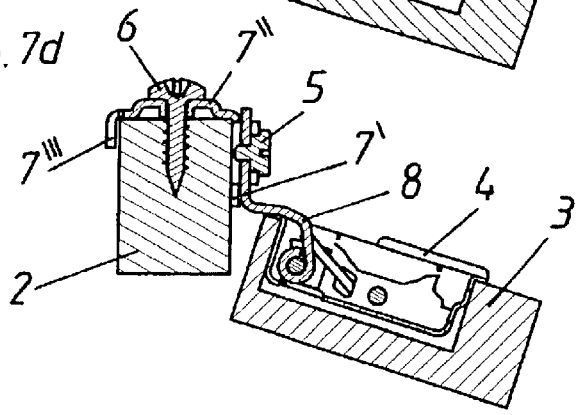

As can be seen from FIGS. 3 and 4 the pre-mounted fastening screw 6 projects over distance 1 from the flange 8". The flange 8' has a length L which is greater than the length l so that when mounting the hinge arm 8 on the frame 2 the flange 8' can abut the side 2' of the frame 2 thereby providing a guiding and positioning means for the hinge arm 8. When the hinge arm is in a position shown in FIG. 9 the fastening screw 6 can be screwed into the frame 2 until the hinge arm 8 is in its fastened position shown in FIG. 7*d*.

In the embodiments of FIG. 4 the hinge arm 8 is provided with a third flange 8'" so that the end of the hinge arm 8 has U-shaped configuration and straddles the frame 2 in order to provide a better hold for the hinge 1 on the frame 2.

Figure 6:
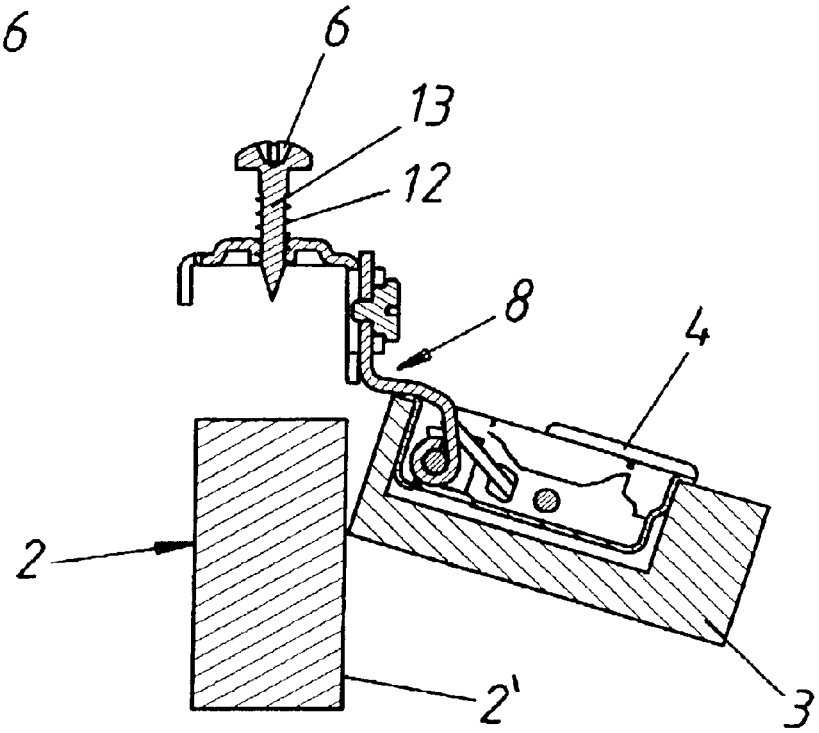
Figure 5:
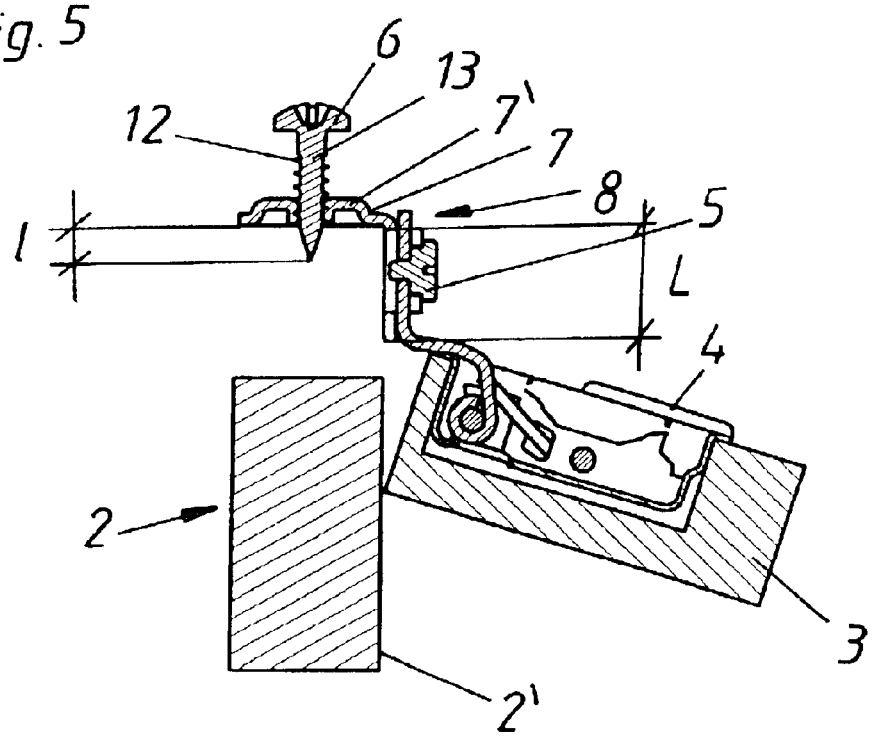

In the embodiment of FIGS. 5 to 7 the end of the hinge arm 8 which is opposed to the hinge pin is connected to a mounting plate 7. Both the hinge arm 8 and the mounting plate 7 are made out of sheet steel. A bridge 10 is stamped out of a flange 7' of the mounting plate 7. The hinge arm 8 is inserted underneath this bridge 10 and secured to the bridge 10 and the flange 7' by means of an eccentric 5. As the mounting plate 7 and the hinge arm 8 are inseparably connected by means of the eccentric 5 the mounting plate 7 is functionally a part of the hinge arm 8. The eccentric 5 allows lateral adjustment of the door 3 in the closed position.

The mounting plate 7 has a first flange 7' and a second flange 7". Like the end of the hinge arm 8 in the embodiments of FIGS. 3 and 4 the second flange 7" of the mounting plate 7 is also provided with an elongated opening 11. The elongated opening 11 has elongated rims, the fastening screw 6 is co-operatively engaged by said rims so that before mounting of the hinge on the frame 2 the fastening screw is held in a middle position of the elongated opening 11. The fastening screw 6 is mounted in the mounting plate 7 in a partly screwed in position as shown in FIGS. 3 to 7. When mounting the hinge arm 8 to the frame 2 the flange 7' of the mounting plate 7 is held onto the side 2' of the frame 2 thereby providing a guiding means for positioning the hinge arm 8. The fastening screw 6 is provided with a threaded section having a self-cutting thread 12, which is inserted in the elongated opening 11 and engaged by the opposed rims of the elongated opening. The fastening screw 6 has a shaft 13. The threaded section 12 has a major diameter than the shaft 13. The diameter of the threaded section 12 is the diametric distance measured between the crests of the thread on opposing sides of the threaded section 12.

The fastening screw 6 is further provided with a head 14 which has a diameter that is greater than the width of the elongated opening 11. The fastening screw 6 is provided with an unthreaded section 15 extending between the head 14 and the threaded section 12. The unthreaded section 14 extends over distance that is greater than the thickness of the flange 7". When the hinge arm 8 together with the mounting plate 7 is mounted on the frame 2 it is positioned by means of the fastening screw 6 which can be turned into the frame 2 without a hole being drilled into the frame 2 thereby fastening the hinge 1 to the frame 2. If it is necessary to correct the position of the hinge 1 with respect to the height of the frame 2 the fastening screw 6 is unscrewed and loosened slightly from its fully screwed imposition so that the unthreaded section 15 corresponds to the rims of the elongated opening 11. Now, the mounting plate 7 with the hinge arm 8 can be re-positioned on the frame 2 in a vertical direction either upward or downward over distance corresponding to the length of the elongated opening 11. When the hinge 1 is in its correct position the fastening screw 6 can be tightened and the hinge 1 is again fastened to the frame 2.

As can be seen from FIGS. 5 to 7 the pre-mounted fastening screw 6 projects over distance 1 from the flange 7". The flange 7' has a length L which is greater than the length l so that when mounting the hinge arm 8 with the mounting plate 7 on the frame 2 the flange 7' can abut the side 2' of the frame 2 thereby providing a guiding and positioning means for the hinge arm 8. When the hinge arm 8 is in a position shown in FIG. 7*c* the fastening screw 6 can be screwed into the frame 2 until the hinge arm 8 is in its fastened position shown in FIG. 7*d*. According to the invention it is not important whether the hinge arm 8 is a one piece hinge arm as shown in FIGS. 3 and 4 or a two piece hinge arm as shown in FIGS. 1, 5, 6 and 7. As the mounting plate 7 and the hinge arm 8 in the embodiments of FIGS. 1 and 5, 6 and 7 are inseparably connected they are one member of the hinge 1. The mounting plate 7 together with the eccentric 5 provide the possibility of lateral adjustment of the door 3 but they don't make any difference with regard to mounting the hinge 1 on the frame 2.

To facilitate screwing in of the fastening screw 6 the fastening screw 6 is, in all embodiments, a self-tapping screw having at its end direct to the way from the head 14 a notch 17 directed rearwardly from said end and cutting through the thread of the fastening screw 6 in the region of its free end. The notch 17 facilitates transport of the wooden material when screwing in the fastening screw 6.

What is claimed is:

1. A hinge for mounting a door on a frame of an article of furniture comprising:

a first hinge member adapted to be mounted to a door of the article of furniture;

a second hinge member adapted to be mounted to a frame of the article of furniture, said second hinge member being the form of a hinge arm having a first end pivoted to said first hinge member and a second end adapted to be mounted to the frame, said second hinge member having first and second flanges disposed at right angles to each other to abut first and second sides of the frame when mounted on the frame; and a self-tapping fastening screw received in an opening of said second flange and held in said second flange in a pre-mounted position of said second hinge member such that said self-tapping fastening screw extends parallel to said first flange and such that said self-tapping fastening screw has a threaded section forming a protruding part that protrudes from said second flange;

wherein said first flange has a length L in a direction perpendicular to said second flange that is greater than a length l of said protruding part of said self-tapping fastening screw.

2. The hinge of claim 1, wherein said opening of said second flange is an elongated opening having elongated rims such that said threaded section of said self-tapping fastening screw is cooperatively engaged with said elongated rims.

3. The hinge of claim 2, wherein said self-tapping fastening screw has a head and an unthreaded shaft section that extends between said head and said threaded section over a distance that is greater than the thickness of said second flange.

4. The hinge of claim 1, wherein said self-tapping fastening screw has a pointed end and a notch directed rearwardly from said pointed end and cutting through the thread of said self-tapping fastening screw.

5. The hinge of claim 1, wherein said second end of said hinge arm has a third flange such that second end forms a U-shaped configuration defined to two side flanges and a center flange of said first through third flanges, said self-tapping fastening screw being held in said second flange which is said center flange.

6. The hinge of claim 5, wherein said third flange has a length in a direction perpendicular to an axle of said hinge that is shorter than the length L of said first flange.

7. The hinge of claim 1, wherein said first and second flanges are in the form of a mounting plate connected to said hinge arm by an adjustment mechanism.

* * * * *